United States Patent [19]

Krutenat

[11] Patent Number: 4,904,500

[45] Date of Patent: Feb. 27, 1990

[54] DIFFUSION OF ELEMENTS INTO STEEL BY CATALYZED OXIDE REDUCTION

[75] Inventor: Richard C. Krutenat, New Providence, N.J.

[73] Assignee: Exxon Research and Engineering Company, Florham Park, N.J.

[21] Appl. No.: 255,895

[22] Filed: Oct. 11, 1988

Related U.S. Application Data

[63] Continuation of Ser. No. 59,423, Jun. 8, 1987, abandoned.

[51] Int. Cl.[4] ..... C23C 16/06; C23C 16/22

[52] U.S. Cl. ..... 427/248.1; 427/250; 427/252; 427/255.1; 427/255.2

[58] Field of Search ..... 427/255.1, 248.1, 255.7, 427/252, 250, 253, 255.2, 226

[56] References Cited

U.S. PATENT DOCUMENTS

| | | | |
|---|---|---|---|
| 3,375,128 | 3/1968 | Baldi et al. | 427/252 |
| 4,141,760 | 2/1979 | Baldi | 427/405 |

FOREIGN PATENT DOCUMENTS

| | | | |
|---|---|---|---|
| 443941 | 7/1975 | U.S.S.R. | 427/252 |
| 908938 | 2/1982 | U.S.S.R. | 427/252 |
| 918331 | 4/1982 | U.S.S.R. | 427/252 |
| 769825 | 3/1957 | United Kingdom | 427/252 |
| 783954 | 10/1957 | United Kingdom | 427/252 |

*Primary Examiner*—Sadie Childs

*Attorney, Agent, or Firm*—Ronald D. Hantman; Joseph J. Dvorak

[57] ABSTRACT

A process for diffusing silicon into iron or iron alloy by heating the iron or iron alloy with silica and a suitable reducing agent in the presence of a catalyst.

7 Claims, 3 Drawing Sheets

EVOLUTION OF GRAIN STRUCTURE DURING SILICONIZING OF LOW-CARBON STEEL

DIFFUSION OF ELEMENTS INTO STEEL BY CATALYZED OXIDE REDUCTION

This is a continuation of application Ser. No. 059,423, filed Jun. 8, 1987, now abandoned.

BACKGROUND OF THE INVENTION

It is often desirable to diffuse an element such as Si or Cr into the surface of iron or an iron alloy to improve its physical and/or chemical properties. It is known that if an element in its uncombined state is exposed in direct contact with another metal or alloy it will diffuse into that alloy. To hasten the diffusion, the temperature is raised. If that temperature exceeds the melting point of the element in question, or if the surface composition during diffusion exceeds the melting point, a liquid phase will form and disrupt the surface. It is desirable that the diffusion be accomplished as rapidly as possible for many purposes, without the hazard of molten phases. At high temperatures, when elements interdiffuse, various intermediate phases can form. These are predicted by the binary phase diagrams, many of which are well known.

For certain specific purposes, such as for electrical steels, it is undesirable to have intermetallic phases at the surface, as a consequence of the interdiffusion. Some inventors have interdiffused silicon into the steel surface by elemental contact, and suggest that the intermetallics can be removed easily by brushing. A far better situation is one in which the intermetallics are not allowed to form by controlling which compositions can form.

The object of this invention is to conduct the diffusion at high temperature and disallow melting by controlling the surface composition to values where molten phases are not produced.

Another object is to disallow formation of intermetallic phases. These phases are particularly undesirable for electrical steels. A further object of this invention is to rapidly interdiffuse silicon into low carbon steel to levels beyond the fabricability limit of 4.5% Si. Levels of 7% have specific magnetic properties, and cannot be made except by prior fabrication into the desired shape and subsequently introducing the desired silicon.

SUMMARY OF THE PRESENT INVENTION

The present invention is a process for diffusing an element into iron or an iron alloy at high temperature without forming a liquid or intermetallic phase at the surface of the iron or iron alloy. In a preferred embodiment of the present invention, the desired element is in the form of its oxide, or some other suitable compound, and that compound is slowly and uniformly reduced by a suitable reducing agent, in the presence of a catalyst that will carry the reduced species to the surface where the desired diffusion is to occur, then the surface will remain solid and its prior characteristics preserved.

DESCRIPTION OF THE PREFERRED EMBODIMENT

Figure 1:
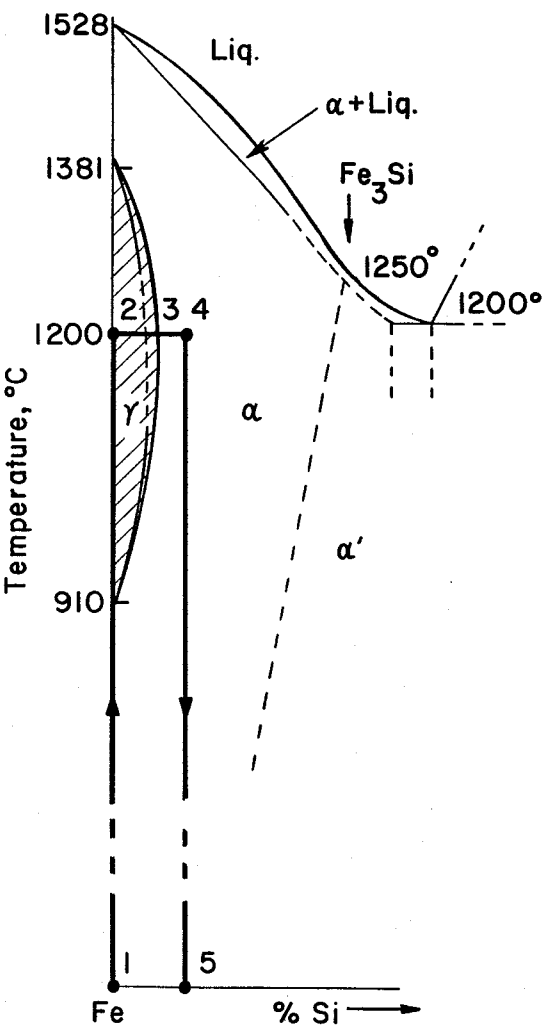
FIG. 1 shows a section of the binary phase diagram for silicon and iron.

In order to effect the desired diffusion, an oxide and reducing agent in a finely divided state are place in proximity to or on the surface to be diffused along with a small suitable fraction of catalyst which activates the reaction to provide the necessary diffusant species.

The process may be carried out in a pack process. A pack is an assembly of powders of different kinds in a tightly closed container. An inert material is used at about 50% to keep metallic particles isolated from one another. An activator or catalyst is included, at a concentration of 1–3% to form volatile halides of the metallic constituents to be diffused. A metallic alloy or combination of alloy or elemental powders is added as the source material to be transported. The article to be treated by diffusion is immersed in the container and the thoroughly mixed ingredients are added to fill the container and exclude all air. Optionally an ingredient designed to inert the pack atmosphere after closing and heating, is often added. A suitable such material for this purpose in diffusing silicon into steel is aluminum nitride.

Suitable catalysts include those that are stable at high temperatures and have vapor pressure lower than one atmosphere at the temperature where the desired reduction-diffusion takes place. Such catalysts include the metal halides $AlF_3$, CuCl, CuI $MgF_2$ and $MgCl_2$.

In this invention, since the source of diffusant is an oxide, this oxide is added along with a suitable reducing agent such that during high temperature processing, the oxide of the designed element is slowly reduced and transported to the surface to be diffused. If silicon is the diffusant, then the oxide is silica. For silica, a suitable reducing agent is aluminum or magnesium. The rate of reduction is governed by the relative amounts of these ingredients and the temperature at which the reduction is effected. At temperatures below 1000° C. aluminum is the predominant diffusion element and the rate of reduction is very slow; the amount of silicon incorporated is then small. However, at higher temperatures, about 1185° C., the predominant reaction is the silica reduction with little or no aluminum incorporated. Hence, it is possible to adjust the composition from all aluminum through to all silicon. The levels of each of these elements is governed by the amount of the two reagents. For example, silicon levels can be adjusted by the relative concentration of aluminum reducing agent in the pack. If magnesium is used as the reducing agent, it will not be incorporated in the steel because it is not soluble. In that case, silicon contents are adjusted by the relative amount of magnesium in the pack.

Other elements that may be diffused besides Si include Al, Sb, Cr, Mo and Mn. In order to effectuate the diffusion for a given element, an appropriate reducer and an appropriate catalyst must be chosen. Selections of a suitable reducing agent are made on the basis of thermodynamics, by calculating the free energy change for an anticipated reaction. If the value is negative, then the reduction can occur. Of the common agents available, aluminum, magnesium and carbon are the most suitable, but refractory elements such as titanium, zirconium, and hafnium could be used. However, they are not practical choices. Other rare earths such as cerium and lanthanium could be used but again these are not generally practical.

Selection of the element to be diffused depends on the end use of the system considered. Silicon is useful in steel for electrical applications such as motors and transformers. Manganese, molybdenum and chromium are desirable for extending corrosion resistance. Antimony has been found useful in electrical steels.

The present invention may be used for the siliconizing of steel. If silicon in its reduced form is placed on the steel surface and then heated, a liquid may form at temperatures between 1000 and 1200° C., depending on the carbon content of the steel, or the alloy content it contains, e.g., Ni, etc.

If the silicon is in contact with the steel as the oxide, $SiO_2$, instead of its elemental form, and $AlF_3$ is present in small amounts, then aluminum, magnesium, iron-aluminum alloy, nickel aluminide (NiAl) or some forms of carbonaceous material will serve to slowly reduce the oxide in the solid state, producing an active diffusant for surface diffusion. Catalyst material is regenerated at the iron or alloy surface. Excess reagents are brushed from the surface.

If aluminum is used as a reducing agent it too may be co-diffused depending on its ratio with the initial silica. If the silica to Al ratio is 3 or greater, only silicon will be diffused into the steel. If the stoichiometric equivalents are used, aluminum tends to be co-deposited by diffusion to produce Si to Al in a ratio of 5:1. Hence, variations of Al and Si content can be varied depending on the desired ratio.

Diffusing either Al or Si produces a stable bcc structure in steel at the diffusing temperature. If other diffusant species are also present, as reducible oxide or as metallic elements, these species, if they exhibit a normally high solubility in the bcc phase at high temperature are found to co-diffuse into the steel. Such co-diffuser elements may be Mo, Sb or Mn. A key requirement for the co-diffusion is the absence of a continuous layer of an intermetallic phase in which the solubility of the co-diffusant is low. Such an intermetallic phase would be NiAl or $Fe_3Al$, depending on the composition of the steel.

In order to limit the kind of layer phases formed, so as to allow selected co-diffusion of elements to take place, the chemical activity of the main diffusant, e.g., Si, or Al, must be regulated to values lower than that in equilibrium with the phase to be avoided. This chemical activity control, as it applies to the diffusion of one or more species, is called controlled activity diffusion. It is accomplished by controlling either the vapor pressure of the reducing agent during the diffusion, or kinetically restricting the access of the reducing agent to the material to be reduced. Kinetic restrictions may include lowering the concentration, or by reducing the availability of the reduction reaction catalyst.

FIG. 1 shows a section of the binary phase diagram for silicon and iron. Indicated are pathways for temperature and composition whereby a steel is heat treated in the presence of a reducible oxide and reducing agent. At temperatures higher than 910° C., the low carbon steel is transformed spontaneously to a face centered cubic structure from its normal room temperature form, body centered cubic. As silica is reduced to latent silicon and transported to the surface, the high temperature causes inward diffusion. As the silicon content in the surface is raised to the phase boundary concentration proscribed by the phase diagram, the face centered cubic structure is transformed isothermally back to the body centered cubic form. A unique metallurgical structure is formed, having columnar grains.

Figure 2:
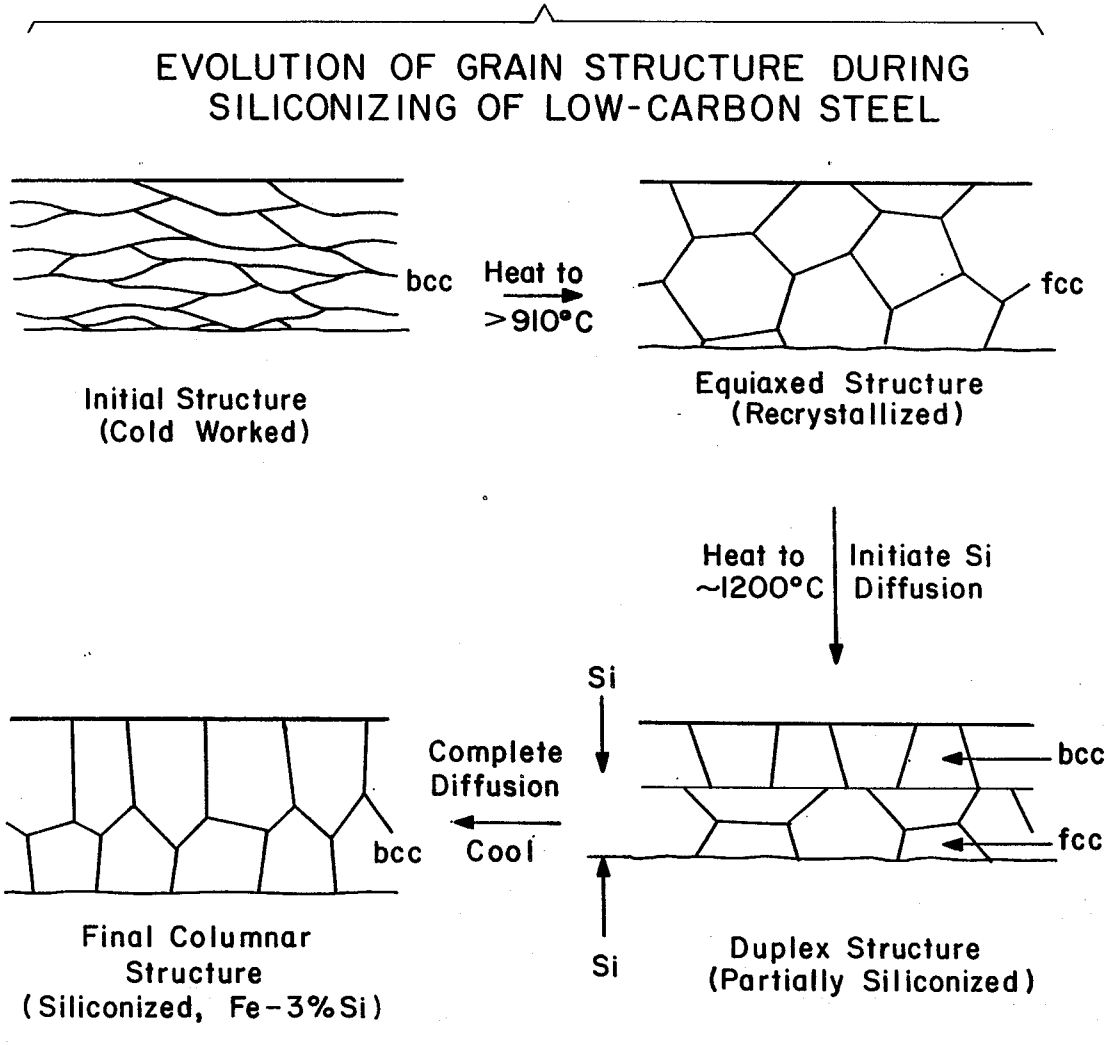
FIG. 2 shows graphically how the structure of the siliconized region is formed.

FIG. 2 shows graphically how the structure of the siliconized region is formed. It also shows how the face centered cubic structure progresses from the diffusion surface into the center of the steel sheet, where a line of grain boundaries results. However, if the silicon content of the starting material is already above the transformation limit proscribed by the phase diagram, then no change in structure will occur during either diffusion or cooling since in this case the body centered structure is stable at all temperatures.

FIGS. 1 and 2 are discussed in more detail in the following paragraphs.

The controlled activity diffusion (CAD) process of the present invention is a high temperature surface modification process, which depends for its success on the ability to control the activity of the coating species in the vapor phase. The parts to be surface modified are sealed off in a steel vessel, which contains a mixture of inert diluent particles (the supporting pack bed), a source of coating (diffusant) element, and a volatile halide activator (catalyst). For coating steels the pack mixture is heated to 900°–1150° C. for 1–24 hrs, depending on the thickness of diffusion coating desired. The coating mechanism involves vapor transport of a volatile halide of the diffusant element to the substrate surface, where a heterogeneous chemical reaction generates the elemental diffusant, which then diffuses into the steel. The volatile diffusant halide is the product of chemical reactions occurring in the pack bed between the halide activator (catalyst) and the diffusant source.

As applied to the siliconizing of low carbon steels, FIG. 1 illustrates the five sequential stages in the process. Stage 1 begins at room temperature, with the steel all bcc ferrite ($\alpha$-phase). During the heat up, bcc ferrite ($\alpha$-phase) transforms to fcc austenite ($\alpha$-phase) above 910° C. This recrystallization is illustrated by the upper part of FIG. 2. In Stage 2, the increase of temperature to 1200° C. promotes increased reaction of the volatile $AlF_3$ activator/catalyst with the diffusant source ($SiO_2$), via a reducing agent (Al), to generate volatile Si-F species. These species diffuse to and disproportionate at the steel surface to release silicon at controlled activity and to recycle fluoride species to the pack bed. Diffusion of silicon into the steel thus proceeds at controlled silicon activity on the steel surface. To achieve the most favorable microstructure, the temperature and activity of the vapor silicon species must be adjusted to promote rapid inward diffusion of silicon. This both prevents outward diffusion of iron, and consequent Kirkendall void formation, and makes good economics possible. The activity of the vapor silicon species must also be low enough to prevent the formation of iron silicide and molten eutectic phases, which can also form in the temperature range 1200°–1250° C. (see phase diagram in FIG. 1). In Stage 3 the siliconizing continues at 1200° C. until the silicon content in the iron exceeds a critical concentration of about 2 wt% Si. At this critical level, there is a phase transformation (at constant temperature) from fcc austenite ($\alpha$-phase) to bcc ferrite ($\alpha$-phase). The lower right portion of FIG. 2 illustrates the propagation of an incoherent interface between the $\alpha$ and $\alpha$ phases, which is responsible for the generation of the coarse grained columnar structure in the siliconized steel. In Stage 4 siliconizing is complete when the transformation interfaces moving inwards from opposite sides meet along the centerline of the part being siliconized, converting the steel to all $\alpha$-phase. The lower left portion of FIG. 2 illustrates the resulting columnar $\alpha$-phase microstructure with, for example, Fe-3% Si, which is retained after cooling to room temperature, Stage 5. It should be emphasized that the process involves diffusion with phase transformation, which is controlled by diffusion in the transformed $\alpha$-phase (bcc iron). Because diffusion rates in bcc iron are as much as 100 times greater than in the parent fcc iron, an economical diffusion through the thickness of the motor laminations can be achieved.

A characteristic feature of the siliconized steel is the low concentration of interstitial elements, e.g. C, O, and N, which is accounted for by the propagation of the incoherent $\alpha/\gamma$ interfaces during siliconizing. Interstitial solubilities are much lower in $\alpha$-iron than in $\gamma$-iron, so these impurities will be rejected towards the center of the steel sheet by the advancing $\alpha/\gamma$ transformation interface during siliconizing. Although initially this will mean a build-up of interstitial impurities in the residual $\gamma$-phase locate along the centerline of the part, after completion of the siliconizing treatment, these impurities can escape via grain boundary diffusion to the vapor phase, provided the necessary chemistry is present for its removal. The low interstitial content of the siliconized steel, coupled with the random orientation of grain structure makes the material attractive for rotating field magnetic applications, e.g. motor laminations. Silicon concentrations from 2.2–6.5 wt% Si can be readily obtained by appropriate adjustments of the silicon activity in the gas phase.

EXAMPLE 1

Figure 3:
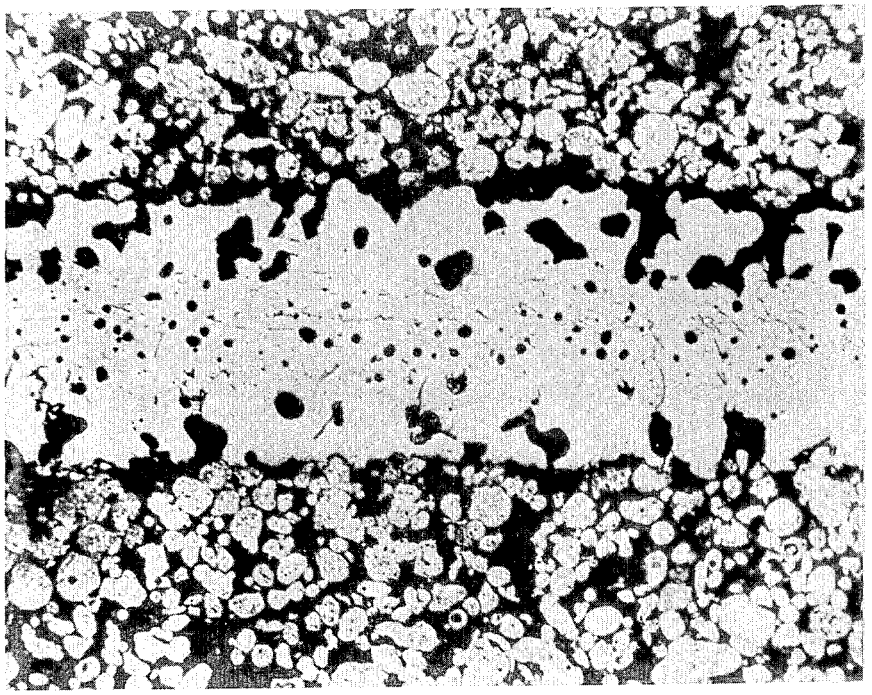
FIG. 3 shows a micrograph of the crosssection of 304 SS siliconized according to the present invention. The foil was disposed in close proximity to quartz crucible (surface) containing NiAl (20%) intermetallic reducing agent, nickel (10%), aluminum oxide (69%) inert filler and 1% ammonium fluoride. Foil specimen was found by microprobe analysis (EDAX) to be siliconized whereas other specimens (800H, 600, 310SS) not in close proximity to the silica surface were aluminized by the NiAl. The magnification is about 250 times.

A type 304 austentic stainless steel foil was in contact with a quartz crucible (source of silicon) containing aluminum oxide (inert material), nickel aluminide, Ni (moderates the aluminum activity), and ammonium fluoride, at 1171° C. for three hours. The 304 SS foil was completely siliconized to about 10% throughout. The silica may be in the form of silicate. FIG. 3 shows the cross section of the siliconized foil.

EXAMPLE 2

Figure 4:
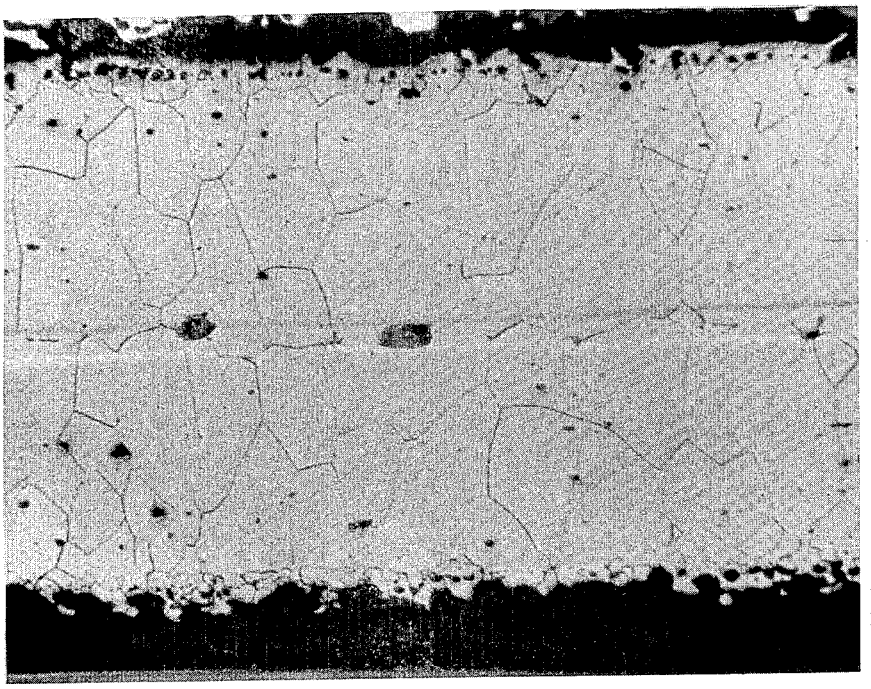
FIG. 4 shows a micrograph of the crosssection of iron foil siliconized according to the present invention. Both surfaces were in contact with silica (3.6%), aluminum (2.1%), aluminum fluoride, $AlF_3$ (1.5%) $Al_2O_3$ (about 82%) and (about 20%) MgO at 1200° C. for 2 hours. Silicon in the steel analyzed as 2.8% at the outer surface (by weight) and 2.3% at the inside region. The magnification is about 125 times.

An excess of silica in contact with an iron foil in the presence of Al was reduced in the presence of $AlF_3$ to silicon which completely diffused through the steel. Magnesium or aluminum silicates are also reduced in the same manner as silica. FIG. 4 shows the siliconized foil.

EXAMPLE 3

Silica, in contact with one side of an iron foil, in the presence of $AlF_3$, was reduced by finely divided charcoal to produce an iron silicon diffused steel throughout the foil thickness, without attendant carbide precipitates. The charcoal may also be replaced by a finely divided silicon carbide.

Hence, if a suitable catalyst is present, solid state reduction of an oxide precursor produces that element diffused into steel, by a variety of suitable reducing agents. Aluminum fluoride catalyst has been found suitable for siliconizing a steel.

Figure 5:
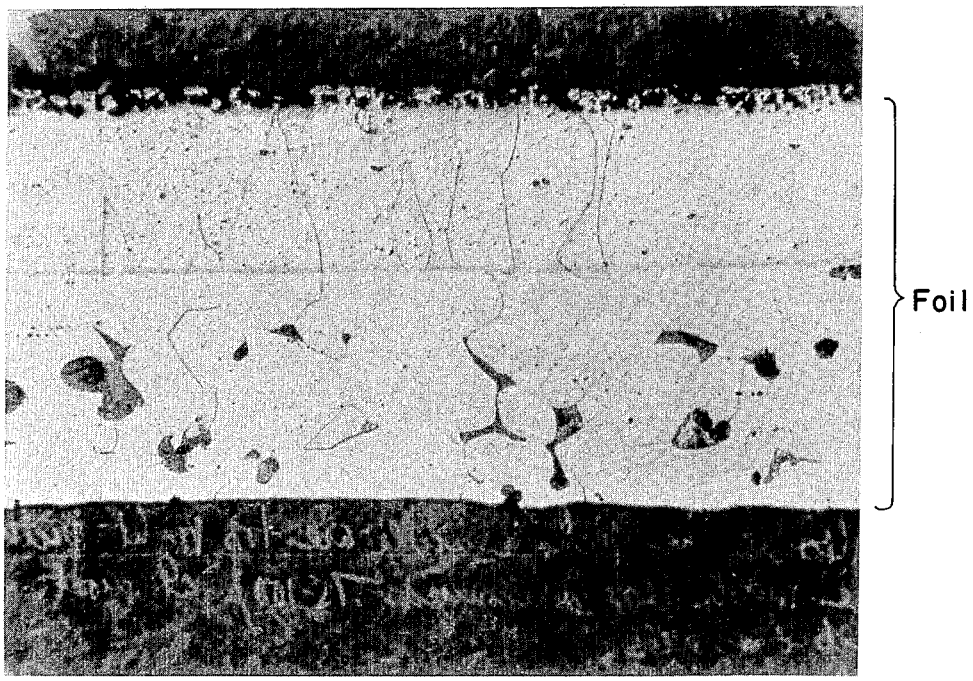
FIG. 5 shows a micrograph of the crosssection of iron foil according to the present invention. The sample was contacted on the upper side with fine silica, milled charcoal and $AlF_3$ catalyst (65%, 29%, 6% respectively). The sample was processed in argon at 1171° C. for 6 hours. Silicon analyzed 3.1% in upper 8 mils of 20 mil thickness. Residual carbides appear as dark etched regions in lower half of specimen. Continued growth of silicon diffusion region rejects carbide at bottom surface. The magnification is about 125 times.

FIG. 5 shows a photomicrograph of a steel siliconized by reducing silica with finely divided carbon. Soluble carbon in the austenite at high temperature is advanced through the structure ahead of the transformation, since its solubility in the bcc phase is low, finally being driven out of the other side of the steel. This figure is an example of one sided diffusion, the silica having been placed only on one side of the steel sheet.

EXAMPLE.4

Chromia, which was found to be reduced by aluminum nitride, forms a 5 mil chromized layer on steel. In this case as well, a catalyst, $AlF_3$, with high temperature stability was found necessary to produce the reaction.

Figure 6:
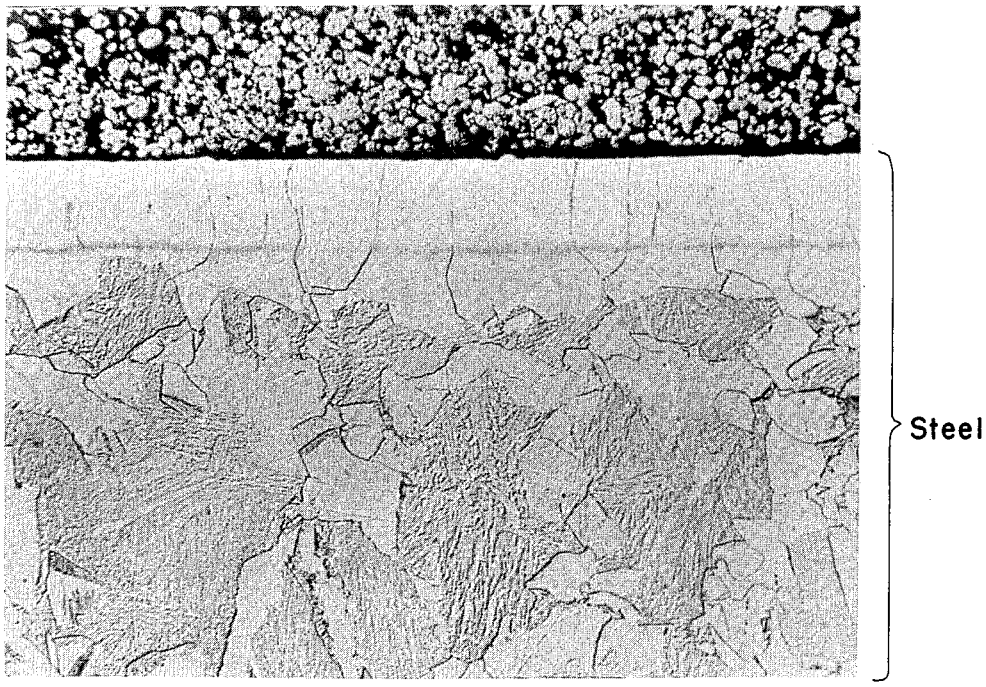
FIG. 6 shows a micrograph of the cross-section of steel diffused with chromium. The sample, A182F5 Fe-5Cr 5% Chrome steel alloy was processed at 1050° C., 10 hrs, in pack consisting of 36% AlN, 58% $Cr_2O_3$, 2% $AlF_3$, 4% MgO. Five mil region at upper surface is chromized. The magnification is about 125 times.

FIG. 6 shows a photomicrograph of a steel diffused with chromium in its surface by the reduction of chromia with aluminum nitride.

What is claimed is:

1. A process for diffusing silicon into iron or an iron alloy comprising heating said iron or iron alloy in the presence of silica with a reducing agent and a catalyst; said heating being conducted at a temperature and for a time sufficient to reduce said silica to silicon and to diffuse the silicon into said iron or iron alloy.

2. The process of claim 1 wherein said reducing agent is selected from the group consisting of aluminum, magnesium, iron-aluminum alloy, NiAl or carbonaceous material.

3. The process of claim 1 wherein said catalyst is a high temperature stable metal halide, having a vapor pressure lower than one atmosphere at the temperature where the desired reduction-diffusion is to take place.

4. The process of claim 3 wherein said metal halide is $AlF_3$, CuCl, CuI, $MgF_2$, $MgCl_2$.

5. The process of claim 1 wherein said heating is conducted in the presence of a co-diffusant species containing an element selected from the group consisting of Al, Sb, Cr, Mo and Mn and regulating the chemical activity of said silicon sufficient to permit co-diffusion of said silicon and said element of said co-diffusion species.

6. The process of claim 5 wherein said species is an oxide.

7. The process of claim 5 wherein said species is an element.

* * * * *